US010718178B2

(12) United States Patent
Kellner

(10) Patent No.: US 10,718,178 B2
(45) Date of Patent: Jul. 21, 2020

(54) PACKER WITH PIVOTABLE ANTI-EXTRUSION ELEMENTS

(71) Applicant: INNOVEX DOWNHOLE SOLUTIONS, INC., The Woodlands, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/090,934

(22) PCT Filed: Apr. 7, 2017

(86) PCT No.: PCT/US2017/026574
§ 371 (c)(1),
(2) Date: Oct. 3, 2018

(87) PCT Pub. No.: WO2017/177119
PCT Pub. Date: Oct. 12, 2017

(65) Prior Publication Data

US 2019/0120011 A1 Apr. 25, 2019

Related U.S. Application Data

(60) Provisional application No. 62/319,350, filed on Apr. 7, 2016.

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1216; E21B 33/128
See application file for complete search history.

(56) References Cited

U.S. PATENT DOCUMENTS

2004/0194969 A1* 10/2004 Hiorth ..... E21B 33/1216 166/382
2009/0255690 A1* 10/2009 Conner ..... E21B 33/1216 166/387

(Continued)

OTHER PUBLICATIONS

Tae Wook Park (Authorized Office), International Search Report and Written Opinion dated Jul. 12, 2017, PCT Application No. PCT/US2017/026574, dated Apr. 7, 2017, pp. 1-18.

(Continued)

*Primary Examiner* — Brad Harcourt
(74) *Attorney, Agent, or Firm* — MH2 Technology Law Group LLP

(57) ABSTRACT

A packer includes a sealing element positioned at least partially around a tubular, the sealing element having an axial end, a gage ring positioned at least partially around the tubular and adjacent to the axial end of the sealing element, and a plurality of petals pivotally coupled to the gage ring, extending at least partially axially therefrom toward the sealing element, and positioned radially outwards of the axial end of the sealing element. The gage ring is movable axially along the tubular, towards the sealing element, such that the gage ring applies an axial force to the sealing element to expand the sealing element radially outwards, and the plurality of petals are configured to pivot radially outwards when the sealing element radially expands.

17 Claims, 8 Drawing Sheets

(56) References Cited

U.S. PATENT DOCUMENTS

| | | | | |
|---|---|---|---|---|
| 2012/0037355 | A1 | 2/2012 | Bishop et al. | |
| 2012/0133098 | A1 | 5/2012 | Farquhar | |
| 2013/0306331 | A1 | 11/2013 | Bishop et al. | |
| 2014/0224476 | A1 | 8/2014 | Frazier | |
| 2014/0262350 | A1* | 9/2014 | Derby | E21B 33/128 166/387 |
| 2014/0262351 | A1 | 9/2014 | Derby | |

OTHER PUBLICATIONS

Athina Nickitas-Etienne (Authorized Office), International Preliminary Report on Patentability dated Oct. 18, 2018, PCT Application No. PCT/US2017/026574, filed Apr. 7, 2017, pp. 1-15.

* cited by examiner

PACKER WITH PIVOTABLE ANTI-EXTRUSION ELEMENTS

CROSS REFERENCE TO RELATED APPLICATIONS

This application is a U.S. National Stage Application of PCT/US2017/026574, filed Apr. 7, 2017, which claims priority to U.S. Provisional Patent Application having Ser. No. 62/319,350, which was filed on Apr. 7, 2016, and which are incorporated herein by reference in their entirety.

BACKGROUND

Packers are generally employed to seal an annulus of a wellbore, e.g., to isolate one section of the wellbore from another. Packers that are designed to be set in an uncased region of a wellbore are known as "open hole" packers. Designing such packers can be challenging, because, unlike packers set in a cased region of the wellbore, the precise dimensions of the surrounding tubular, i.e., the wellbore wall, can vary widely. For example, open-hole packer designs generally account for the possibility of setting the packer in a washed-out section of the wellbore.

Such open-hole packers typically use a sealing element that is expandable to create the desired seal with the wellbore. A variety of such sealing elements are known, and can be expanded in a variety of manners (swelling, inflating, mechanically, etc.). The sealing element can be highly-expandable, and able to form a seal even in the presence of a wash-out or the like. However, in high-pressure and/or high-expansion situations, e.g., in mechanically- or hydraulically-expanded packers, axial forces incident on the sealing member can deform the soft sealing member. When this happens, the sealing member can extrude through the annulus, which can negatively impact the integrity of the seal.

Relatively thin back-up rings, generally made from metal, are thus sometimes positioned adjacent to the sealing element to combat such extrusion. However, such back-up rings are prone to failure, especially in high-expansion applications. For example, the axial load and high radial expansion can cause back-up rings to bend and break, leaving the sealing element unprotected from extrusion.

SUMMARY

Embodiments of the disclosure may provide a packer including a sealing element positioned at least partially around a tubular, the sealing element having an axial end, a gage ring positioned at least partially around the tubular and adjacent to the axial end of the sealing element, and a plurality of petals pivotally coupled to the gage ring, extending at least partially axially therefrom toward the sealing element, and positioned radially outwards of the axial end of the sealing element. The gage ring is movable axially along the tubular, towards the sealing element, such that the gage ring applies an axial force to the sealing element to expand the sealing element radially outwards, and the plurality of petals are configured to pivot radially outwards when the sealing element radially expands.

Embodiments of the disclosure may also provide a method for packing a wellbore. The method includes deploying a sealing element positioned around a tubular into the wellbore, the sealing element being in a run-in configuration, and causing a gage ring positioned axially adjacent to the sealing element to move toward the sealing element. Causing the gage ring to move causes the gage ring and a plurality of petals to apply an axial force to the sealing element, expanding the sealing element radially outward to a set configuration. As the sealing element expands radially outwards, the plurality of petals pivot radially outwards to prevent extrusion of the sealing element past the gage ring.

Embodiments of the disclosure may also provide an apparatus for packing a wellbore. The apparatus includes a sealing element positioned around a tubular and having a first axial end, a second axial end, and a main portion between the first and second axial ends, the sealing element being expandable to form a seal between the tubular and a surrounding wall. The apparatus also includes a first gage ring positioned around the tubular, the first gage ring comprising an end surface that abuts the first axial end of the sealing element. The apparatus further includes a second gage ring positioned around the tubular, the second gage ring comprising an end surface that abuts the second axial end of the sealing element. The apparatus also includes a first plurality of petals pivotally coupled to the first gage ring and extending therefrom towards the second gage ring, the first plurality of petals being positioned radially outward of at least a portion of the sealing element. Adjacent ones of the first plurality of petals are overlapping. The apparatus also includes a second plurality of petals pivotally coupled to the second gage ring and extending therefrom towards the first gage ring, the second plurality of petals being positioned radially outward of at least a portion of the sealing element. Adjacent ones of the second plurality of petals are overlapping.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
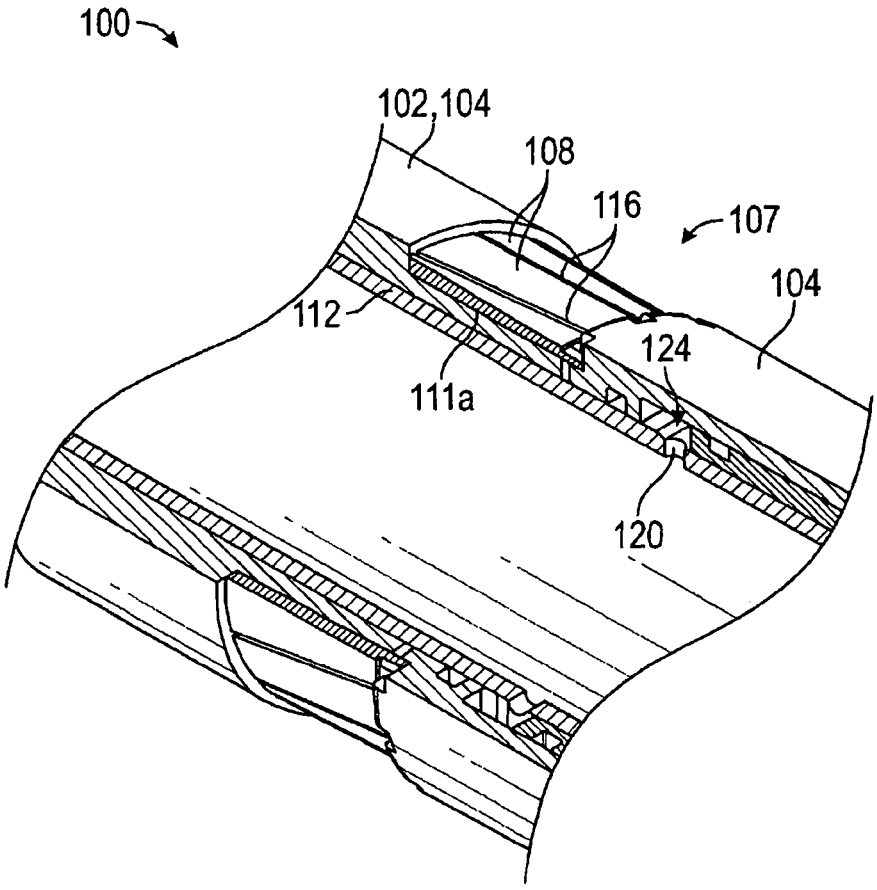
FIG. 1 illustrates a perspective view of a section of a packer in a run-in configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure provide an apparatus for forming a seal in a wellbore, e.g., a packer. The packer may be configured for use in an open-hole region of the wellbore, but may also be configured for use in cased-hole regions. The packer generally includes a sealing element with a pair of gage rings on either side, which are positioned around a tubular. The gage rings are movable axially toward one another, which serves to squeeze the sealing element radially outward, toward the surrounding tubular (e.g., the wellbore wall). The packer may also include a pair of expandable back-up rings between the gage rings and the sealing element. The back-up rings may each generally be constructed from a set of petals, with one set connected to each of the gage rings. The petals may be pivotally coupled to the gage rings, and may overlap end portions of the sealing element. Accordingly, as the sealing element is expanded radially outward, the petals may pivot radially outward therewith. Further, the petals may be circumferentially overlapping, such that the petals substantially prevent or at least reduce extrusion of the sealing element.

Figure 2:
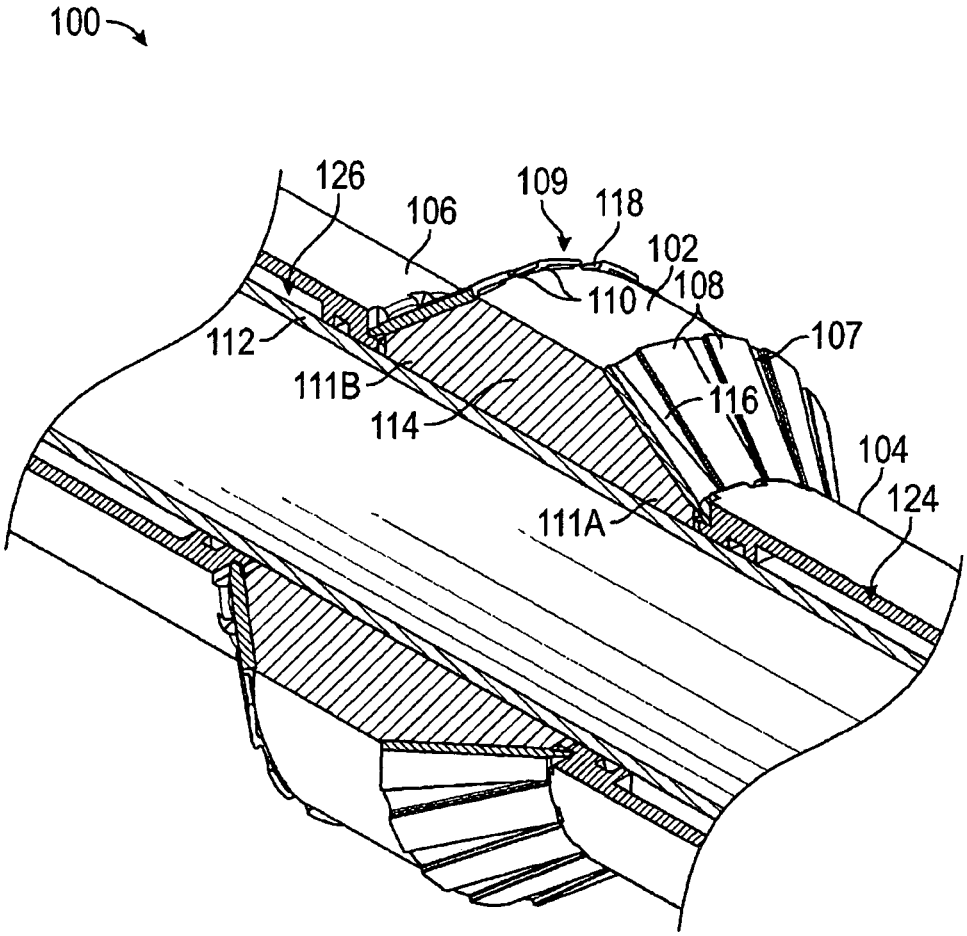
FIG. 2 illustrates a perspective view of a second of the packer in a set configuration, according to an embodiment.

Turning now to the specific, illustrated embodiments, FIG. 1 depicts a perspective view of a packer 100 having its components in a run-in configuration, according to an embodiment. FIG. 2 depicts a perspective view of a section of the packer 100 having its components in a deployed configuration, according to an embodiment. Referring to both FIGS. 1 and 2, the packer 100 may include a sealing element 102, a first gage ring 104, a second gage ring 106, a first back-up ring 107, and a second back-up ring 109, each of which may be positioned at least partially around a tubular 112. In an embodiment, the sealing element 102 may be positioned axially between the first and second gage rings 104, 106. As the term is used herein, "axially" means in a direction parallel to a central longitudinal axis of the tubular 112.

The first back-up ring 107 may include a first set of petals 108, and the second back-up ring 109 may include a second set of petals 110. The first set of petals 108 may be pivotally coupled to the first gage ring 104 and may extend axially therefrom, toward the sealing element 102 and the second gage ring 106. Similarly, the second set of petals 110 may be pivotally coupled to the second gage ring 106 and may extend axially therefrom, toward the sealing element 102 and the first gage ring 104. The first and second sets of petals 108, 110 may overlap (i.e., be positioned radially outward of) recessed end portions 111A, 111B of the sealing element 102, respectively.

In an embodiment, the sealing element 102 may have a main portion 114 that is not overlapped by the first and second sets of petals 108, 110, at least in the run-in configuration of the packer 100, i.e., prior to expansion of the sealing element 102. The main portion 114 may be axially between the recessed end portions 111A, 111B and may have a greater outer diameter than the recessed end portions 111A, 111B, such that the outer diameter surface of the main portion 114 may be configured to contact and seal with a surrounding tubular when the sealing element 102 is expanded. The first and second sets of petals 108, 110 may thin, in a radial direction, and may sized so as to be located in the annular pockets defined by the recessed end portions 111A, 111B.

The first set of petals 108 may overlap one another circumferentially, forming at least first interfaces 116 that extend generally axially therebetween. For example, as shown, the first interfaces 116 may extend axially, as well as in a circumferential direction with respect to the tubular 112. The second set of petals 110 may similarly overlap one another, forming at least second interfaces 118 extending axially as well as in a circumferential direction. The circumferential directions in which the interfaces 116, 118 extend may be opposite, but in other embodiments, may be the same. An example of a shape of the petals 108, 110 and interfaces 116, 118 therebetween will be described in greater detail below.

The first and second gage rings 104, 106 may be forced axially toward one another, which applies an axial force on the sealing element 102 that expands the sealing element 102 radially outwards, transitioning the packer 100 to a set configuration, as shown in FIG. 2 by way of example. As the sealing element 102 expands radially outwards, the petals 108, 110 may pivot outwards with respect to the gage rings 104, 106, so as to continue to overlap at least a portion of the sealing element 102. At least a portion of the axial force applied to the sealing element 102 by the gage rings 104, 106 may be applied via the petals 108, 110.

As the petals 108, 110 pivot, the interfaces 116, 118 expand circumferentially, as proceeding axially away from the gage rings 104, 106, respectively. However, the petals 108, 110 may overlap circumferentially along at least a majority of adjacent petals 108, 110, even after being pivoted outwards. Further, the petals 108, 110 may be configured to engage the inner surface of the surrounding wellbore wall or tubular, which may prevent the sealing element 102 from rolling over the back-up rings 107, 109 and/or may form a metal seal with the tubular. Further, as the petals 108, 110 are individually articulating, at least in some embodiments, the petals 108, 110 may be able to form a seal despite the tubular or wellbore wall having contours and/or having a relatively large degree of ovality where the seal is to be formed.

In an embodiment, the gage rings 104, 106 may be moved together by hydraulic pressure supplied via the tubular 112. For example, the tubular 112 may include ports 120 radially therethrough. The ports 120 may communicate with one or more chambers 124, 126 defined in the gage rings 104, 106, respectively (ports communicating with the chamber 126 are not visible in this view). In some embodiments, several chambers/ports may be provided for each gage ring 104, 106. When the pressure within the tubular 112 is increased to a predetermined actuation pressure, the pressure may force the gage rings 104, 106 to move toward one another, thereby axially compressing and radially expanding the sealing element 102.

Figure 3:
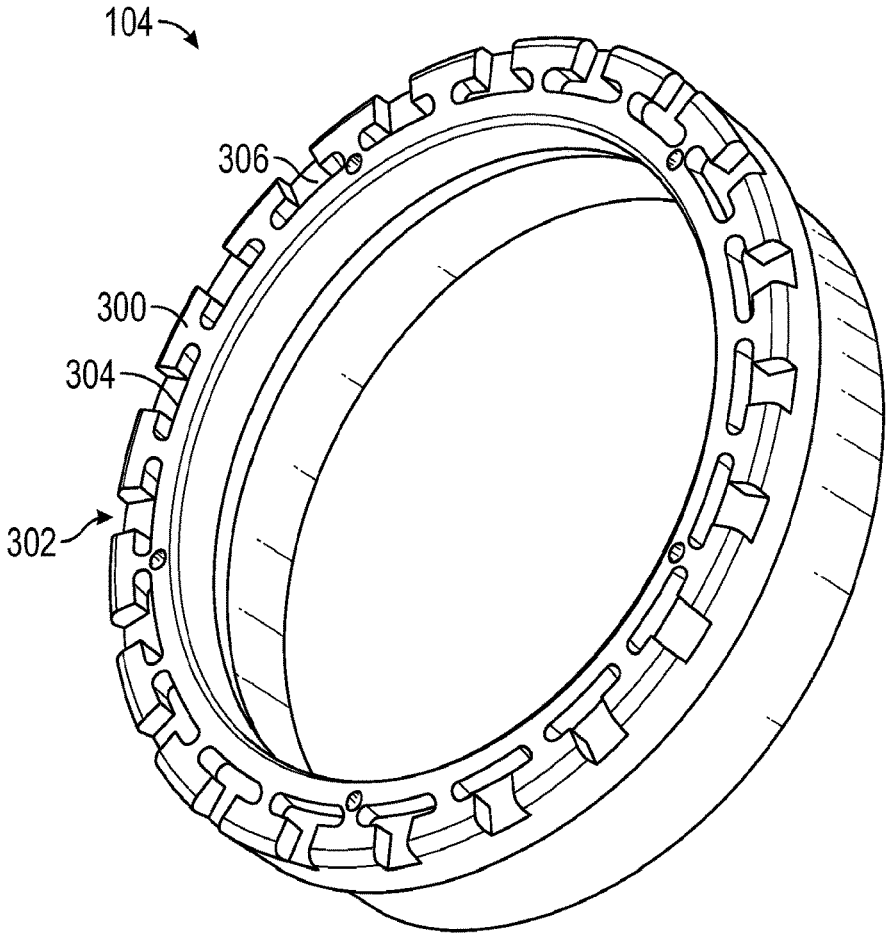
FIG. 3 illustrates a perspective view of a gage ring of the packer, according to an embodiment.

FIG. 3 illustrates a perspective view of the gage ring 104, according to an embodiment. It will be appreciated that the gage ring 106 may be substantially the same in structure and function in at least some embodiments. As shown, the gage ring 104 includes an axial end face 300. The axial end face 300 may abut an axial end of the sealing element 102 (FIGS. 1 and 2) and may bear upon the axial end of the sealing element 102 in order to transmit at least a portion of the axially compression force onto the sealing element 102.

The axial end face 300 may define pockets 302 therein. In particular, the pockets 302 may include a rounded, hinge-receiving portion 304 that extends generally circumferentially therein. Further, the pockets 302 may each include a radially-extending groove 306 that intersects the hinge-receiving portion 304 and extends outward therefrom. The functioning of these features of the pocket 302 will be described in greater detail below. Any number of pockets 302 may be employed, e.g., the same number as the number of petals 108, although more or fewer pockets 302 may be provided. Further, the pockets 302 may be uniformly distributed circumferentially about the gage ring 104 or may be positioned in any suitable pattern. In some embodiments, the grooves 306 may be omitted.

Figure 4A:
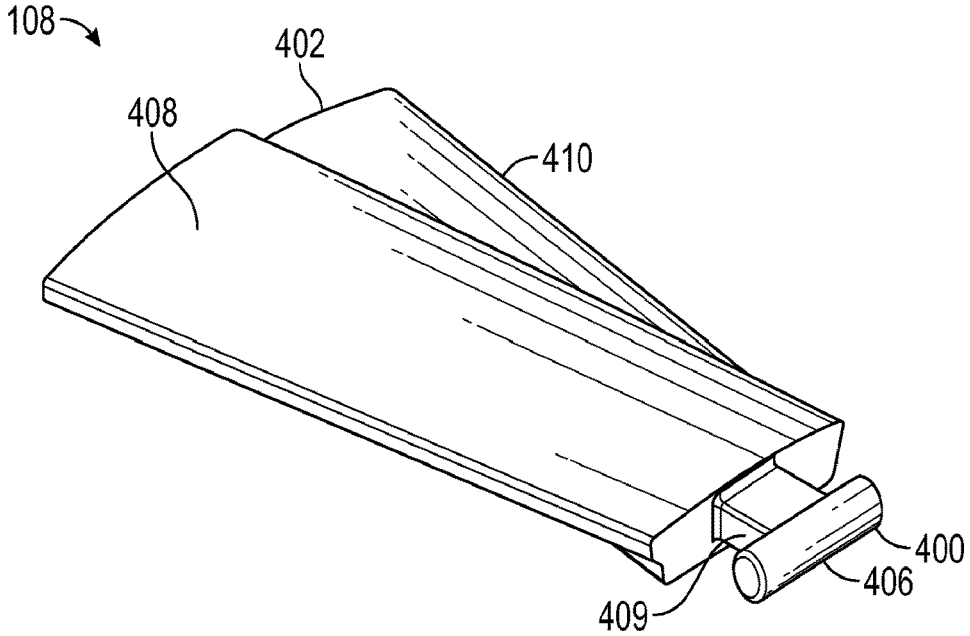
FIG. 4A illustrates a perspective view of a petal of the packer, according to an embodiment.
Figure 4B:
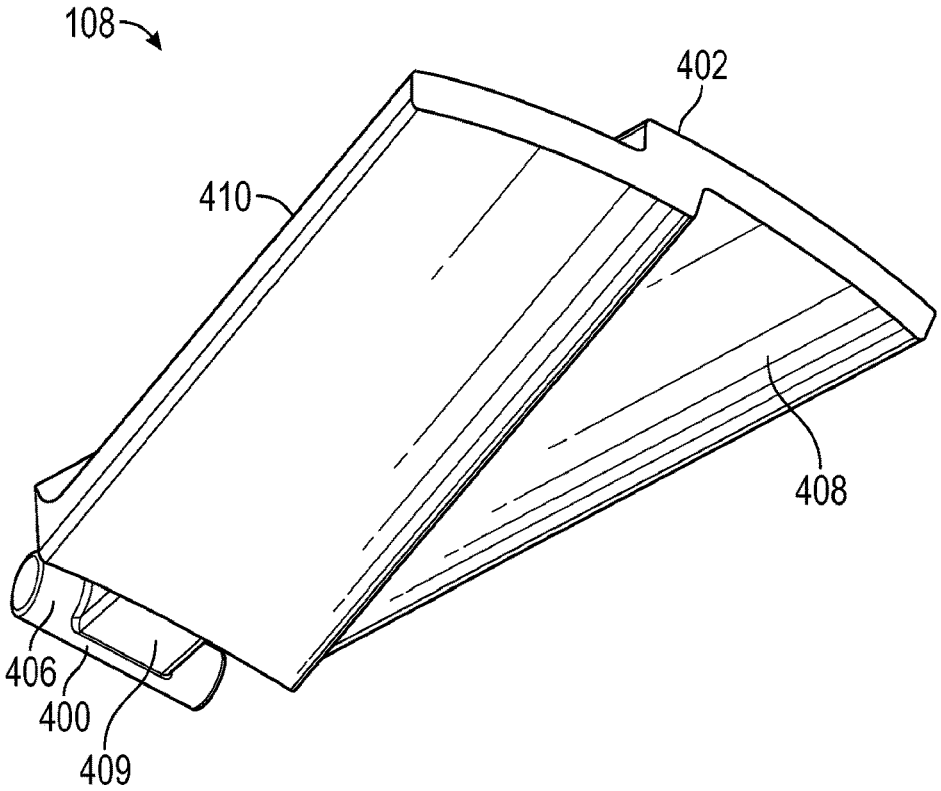
FIG. 4B illustrates another perspective view of the petal of the packer, according to an embodiment.

FIGS. 4A and 4B illustrate perspective views of one of the petals 108, according to an embodiment. It will be appreciated that the other petals 108 and/or the petals 110 may be substantially the same in structure and function, in at least one embodiment.

In the illustrated embodiment, the petal 108 includes a root 400 and a tip 402, defining the axial extents of the petal 108. Further, the petal 108 includes a hinge member 406 at the root 400, as well as a first axially-extending section 408, and a second axially extending section 410. The first and second sections 408, 410 may be coupled to and extend from a post 409 connected to the hinge member 406, to the tip 402 on the opposite side. The first and second axially-extending sections 408, 410 may also be oriented at an angle to one another, as shown, such that the width of the petal 108 increases as proceeding along the first and second sections 408, 410 toward the tip 402.

In some embodiments, the first and section sections 408, 410 may be integrally formed as a single piece. In other embodiments, the first and second sections 408, 410 may be welded, fastened, or otherwise connected together, or may not be connected together away from the hinge member 406. The first and second sections 408, 410 may overlap one another, as shown, such that, when assembled on the tubular 112 (see FIG. 1), the first section 408 is radially outward of the section 410.

The first and second sections 408, 410 may be rigidly connected to the hinge member 406, such that the petal 108 is capable of pivoting by rotation of the hinge member 406. In other embodiments, the hinge member 406 may include stationary and rotatable portions (e.g., bushing and an axle or the like) that facilitate the pivoting movement of the petals 108. In some embodiments, the hinge member 406 may be spring-biased, e.g., so as to pivot the tip 402 toward the sealing element 102 (e.g., FIG. 1).

Figure 5:
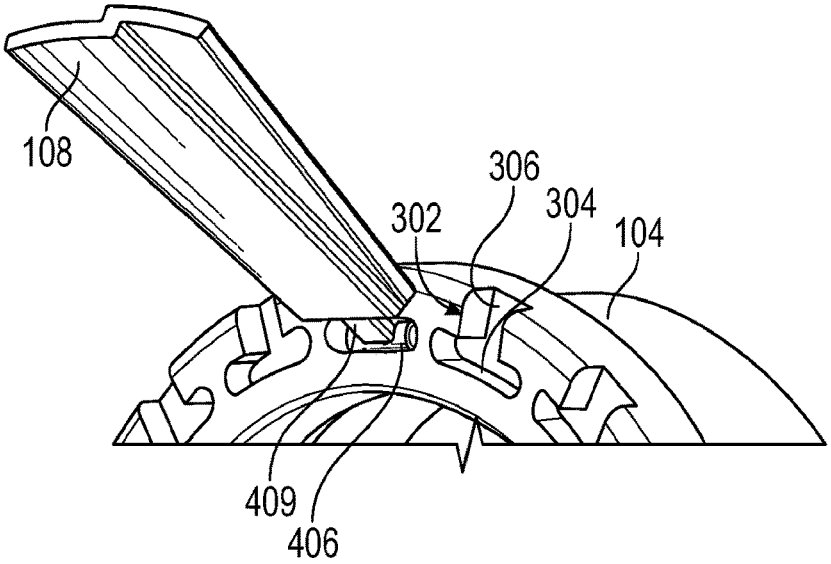
FIG. 5 illustrates a perspective view of adjacent overlapping petals pivotally coupled to the gage ring of the packer, according to an embodiment.

FIG. 5 illustrates one of the petals 108 pivotally connected to the gage ring 104, according to an embodiment. As shown, the hinge member 406 is received into one of the pockets 302 of the gage ring 104. The hinge member 406 may be received into holes, slots, or grooves in the pocket 302, or may bear against the wall of the pocket 302. Accordingly, the petal 108 may be pivotal about the hinge member 406, with respect to the gage ring 106. Further, the post 409 of the petal 108 may align with the groove 306 of the pocket 302, providing for an increased clearance between the petal 108 and the gage ring 104, and thus an increased range of pivoting motion for the petal 108, in embodiments including these features.

Figure 6A:
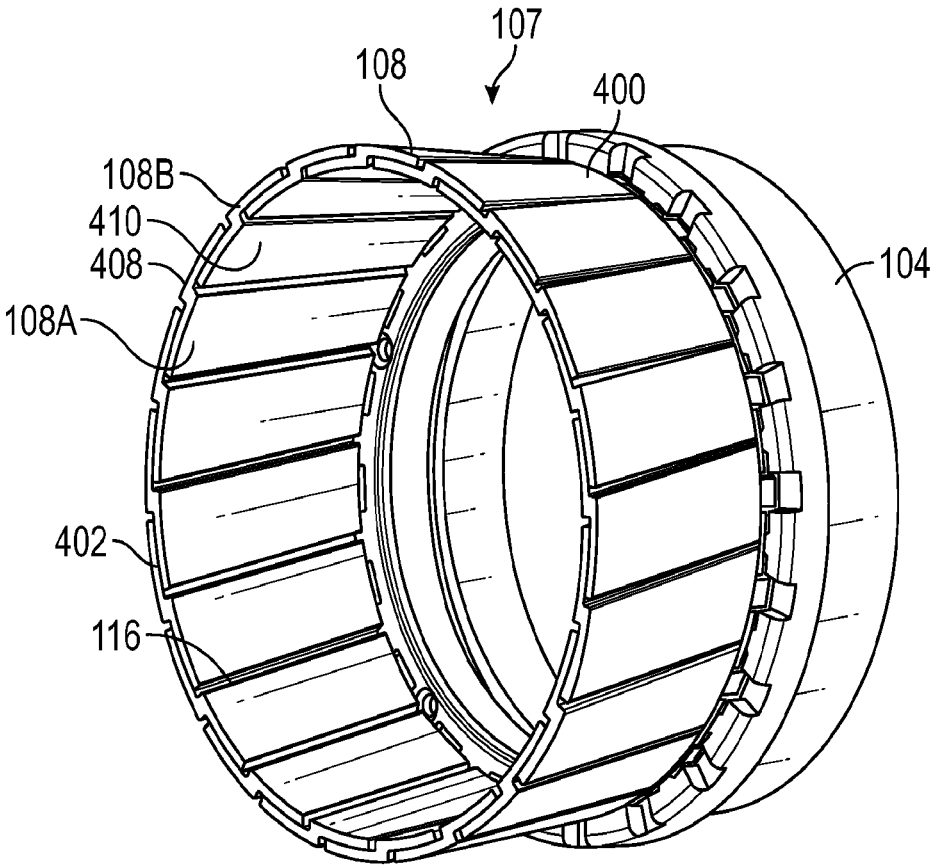
FIG. 6A illustrates a perspective view of a back-up ring formed from a plurality of the petals pivotally coupled to the gage ring, according to an embodiment.

FIG. 6A illustrates a perspective view of the gage ring 104 with the petals 108 pivotally coupled thereto so as to form the back-up ring 107, in the run-in configuration, according to an embodiment. As mentioned above, the petals 108 are circumferentially overlapping. Such overlapping is evident in FIGS. 6A and 6B. For example, as shown, the first section 408 of one of the petals 108A overlaps the second section 410 of an adjacent one of the petals 108B. Further, in the run-in configuration of FIG. 6A, since the petals 108 increase in width (in the circumferential direction), the extent of the overlapping increases as proceeding away from the gage ring 104, toward the tips 402.

Figure 6B:
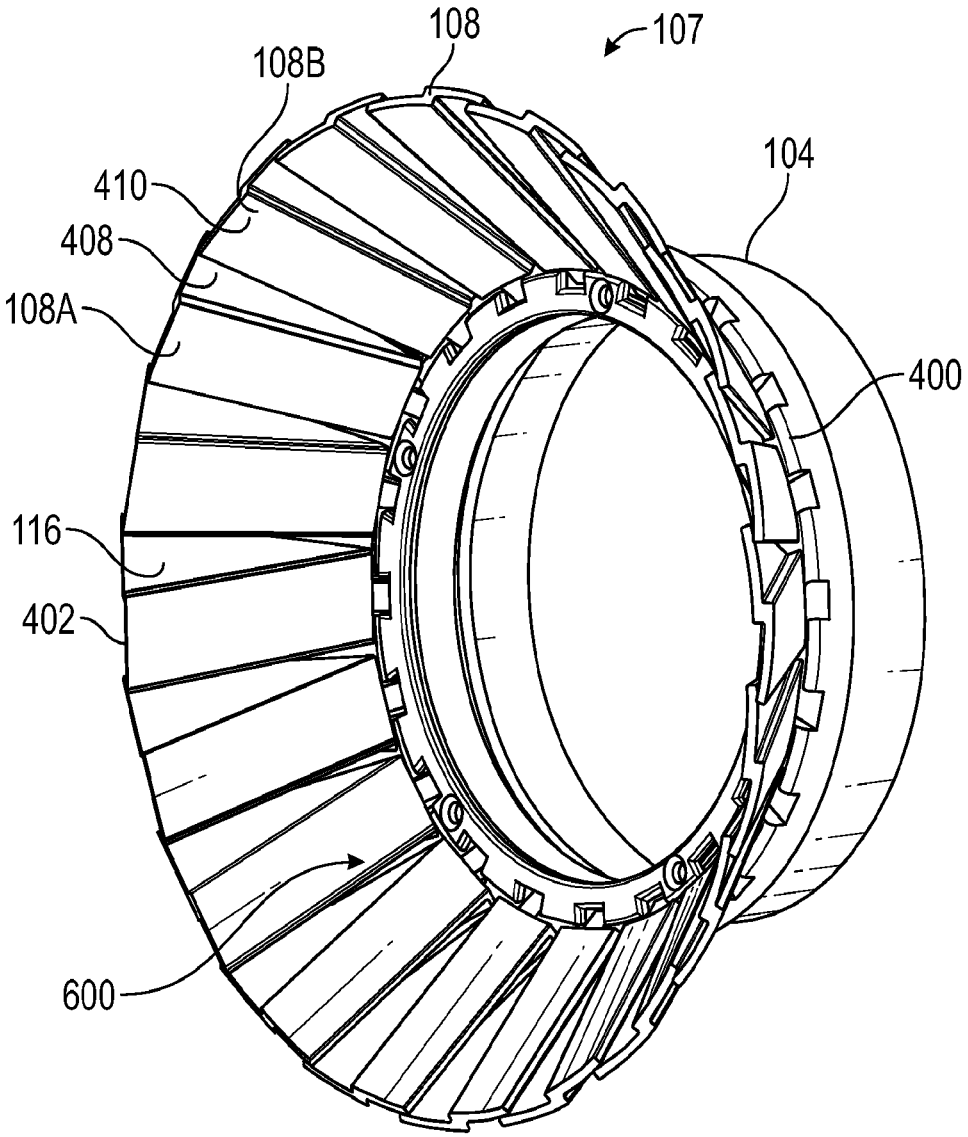
FIG. 6B illustrates a perspective view of the plurality of petals of the back-up ring pivoted outwards with respect to the gage ring, according to an embodiment.

FIG. 6B illustrates a perspective view of the gage ring 104 with the petals 108 pivotally coupled thereto so as to form the back-up ring 107, in the deployed configuration, according to an embodiment. As shown, the petals 108 are pivoted outward (i.e., the tips 402 thereof are farther radially outward) with respect to the gage ring 104 from their position in the run-in configuration of FIG. 6A. Accordingly, the circumference of the back-up ring 107 at the farther away from the gage ring 104 is greater than the circumference of the back-up ring 107 closer thereto. Since the circumferential width and thus overlapping of the petals 108 increases as proceeding toward the tips 402 thereof, the result of this pivoting motion is that the interfaces 116 therebetween increase in size, increasingly so as proceeding toward the tip 402, but the petals 108 may remain overlapping. As shown, near the root 400, e.g., proximal to the gage ring 104, optionally some spaces 600 between the petals 108 may develop as a consequence of the pivoting of the petals 108, but this may not substantially impair the functioning of the back-up rings 107, e.g., the elastomeric sealing element 102 (FIG. 1) may not substantially extrude through such gaps 600.

Figure 7:
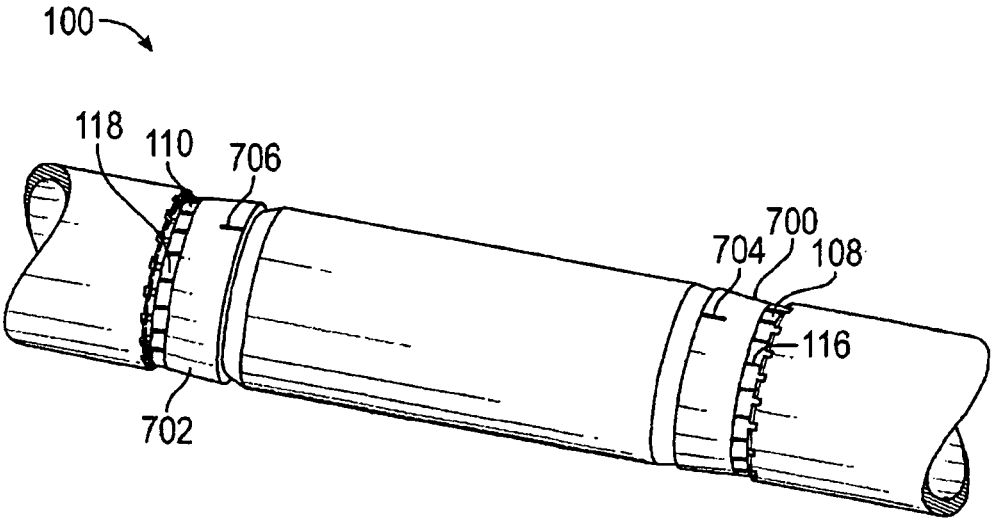
FIG. 7 illustrates a perspective view of the packer, showing retainer rings that may be included therewith, according to an embodiment.

FIG. 7 illustrates a perspective view of the packer 100, according to an embodiment. As shown, the packer 100 may include retainers 700, 702 positioned around the petals 108, 110 respectively. The retainers 700, 702 may be configured to hold the petals 108, 110 against the sealing element 102, or otherwise in a contracted state, prior to deployment/expansion of the sealing element 102.

The retainers 700, 702 may be fabricated from any material suitable for performing the task of hold the petals 108, 110 in this position until deployed. For example, the retainers 700, 702 may be shrink wrap, a polymer (e.g., polyether ether ketone (PEEK)), a composite material, and/or a metal. For example, the retainers 700, 702 may be brass. Furthermore, the retainers 700, 702 may be constructed to include one or more notches 704, 706, as shown, which may facilitate and allow for adjustment of the fracturing of the retainers 700, 702. In some embodiments, two or four such notches 704, 706 may be included, e.g., at uniform angular intervals, but this is just one example among many contemplated.

Also visible in FIG. 7, as mentioned above, the circumferential direction in which the interfaces 116, 118 between the petals 108, 110 may be opposing.

Figure 8:
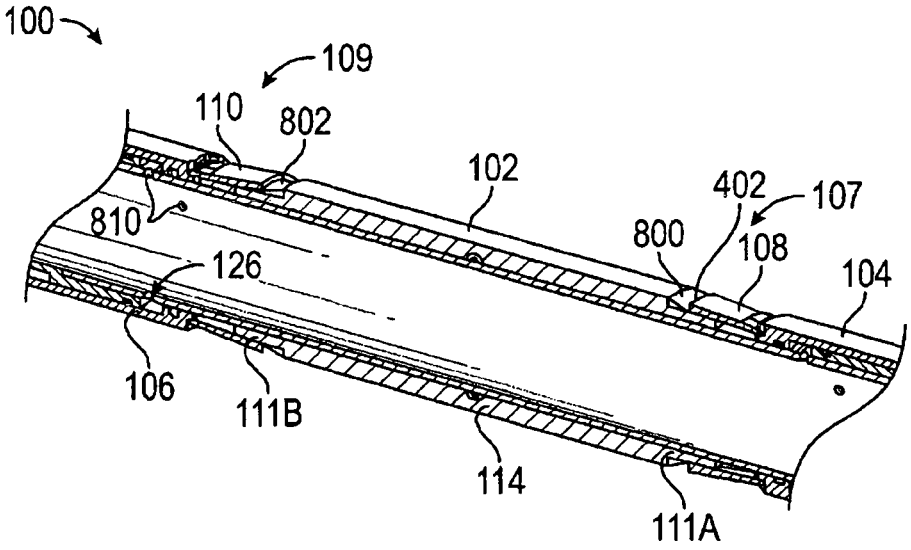
FIG. 8 illustrates a cross-sectional view of the packer, showing wedge rings that may be included therewith, according to an embodiment.

FIG. 8 illustrates a cross-sectional view of the packer 100, according to an embodiment. As described above, the packer 100 may include the sealing element 102, gage rings 104, 106, and back-up rings 107, 109 (e.g., the petals 108, 110). Further, the sealing element 102 may include the main portion 114 and the end portions 111A, 111B, which have a recessed (reduced) diameter with respect to the main portion 114.

In some embodiments, the packer 100 may include optional wedge rings 800, 802. The wedge ring 800 may be positioned in the end portions 111A, 111B, and may be tapered from nearly the diameter of the end portion 111A, 111B to the diameter of the main portion 114, at least prior to expansion. The wedge rings 800, 802 may be harder than the sealing element 102. For example, the wedge rings 800, 802 may be metal, which may be harder than the elastomer of the sealing element 102.

Accordingly, the tips 402 of the petals 108, 110 may engage or otherwise bear upon the wedge rings 800, 802. Thus, the wedge rings 800, 802 may provide for sliding engagement with the petals 108, 110, facilitating the petals 108, 110 pivoting outwards under force from the gage rings 104, 106. This may, for example, facilitate reliable breaking of the retainers 700, 702 and expansion of both sets of petals 108, 110.

Also visible in FIG. 8, as mentioned above, is a pressure-transmitting port 810 through the tubular 112 that communicates with the chamber 126, so as to drive the gage ring 106 toward the gage ring 104 and thereby compress and expand the sealing element 102.

Figure 9:
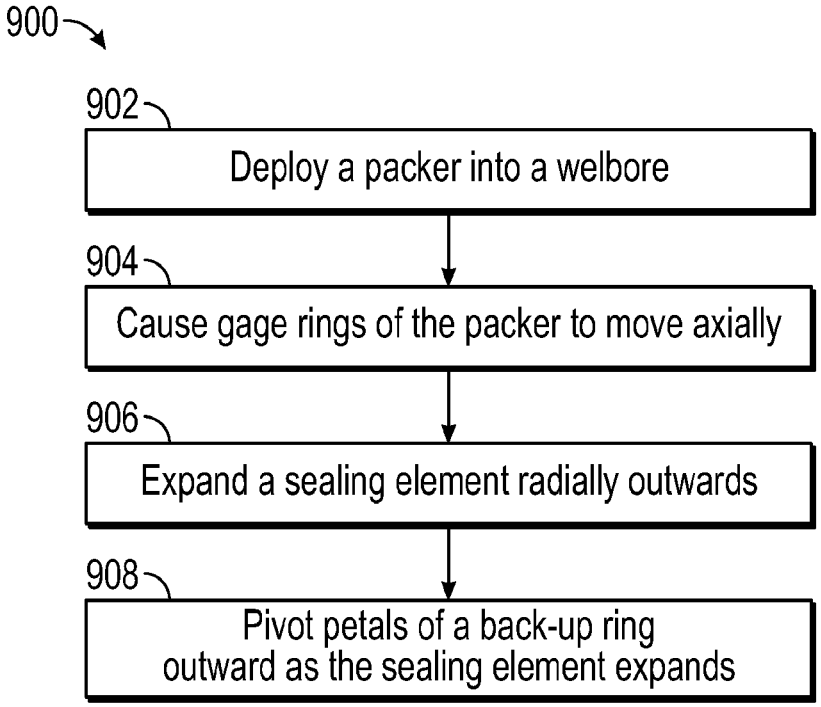
FIG. 9 illustrates a flowchart of a method for packing a wellbore, according to an embodiment.

FIG. 9 illustrates a flowchart of a method 900 for packing a wellbore, e.g., an open-hole section thereof, according to an embodiment. The method 900 may proceed by operation of an embodiment of the packer 100 discussed above, and is described herein with respect thereto as a matter of convenience. However, some embodiments may employ other packers, and thus the method 900 is not limited to any particular structure unless otherwise stated herein.

The method 900 may include deploying a packer 100 including a sealing element 102 positioned around a tubular 112 into the wellbore, while the sealing element 102 is in a run-in configuration, as at 902. The method 900 may then proceed to causing a gage ring (e.g., gage ring 104) positioned axially adjacent to the sealing element 102 to move toward the sealing element, as at 904. Causing the gage ring to move at 904 may in turn cause the gage ring 104 and a plurality of petals (e.g., petals 108) to apply an axial force to the sealing element 102, thereby expanding the sealing element 102 radially outward to a deployed configuration, as at 906. As the sealing element 102 expands radially outwards, the plurality of petals 108 may pivot radially outwards to prevent extrusion of the sealing element 102 past the gage ring 104, as at 908.

Further, in at least some embodiments, causing the gage ring to move at 904 includes increasing a pressure within the tubular 112. The increased pressure is transmitted to the gage ring 104 via a port 120 in the tubular 112 that communicates with a chamber 124 in the gage ring 104. In addition, when the sealing element 102 is in the run-in configuration, the plurality of petals 108 may be positioned radially outward of an axial end portion 111A of the sealing element 102.

In some embodiments, causing the gage ring 104 to move at 904 in turn causes a retainer (e.g., retainer 700) positioned around the plurality of petals 108 to rupture, allowing the plurality of petals 108 to pivot outwards with respect to the gage ring 104. In some embodiments, the plurality of petals 108 are at least partially circumferentially overlapping when the sealing element 102 is in the run-in configuration and when the sealing element is in the deployed configuration.

In some embodiments, causing the gage ring to move at 904 causes tips 402 of the plurality of petals 108 opposite to the gage ring 104 to engage a wedge ring (e.g., the wedge ring 800), the wedge ring 800 being positioned around a recessed portion of the gage ring 104. The wedge ring 800 may be harder than the sealing element 102, so as to facilitate the expansion of the petals 108 breaking the retainer 700 and/or otherwise expanding.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A packer, comprising:

a sealing element positioned at least partially around a tubular, the sealing element having an axial end;

a gage ring positioned at least partially around the tubular, the gage ring defining an axial face that directly contacts the axial end of the sealing element; and a plurality of petals pivotally coupled to the gage ring, extending at least partially axially from the axial face and toward the sealing element, and positioned radially outwards of the axial end of the sealing element, wherein the gage ring is movable axially along the tubular, towards the sealing element, such that the axial face of the gage ring applies an axial force to the axial end of the sealing element to expand the sealing element radially outwards, and wherein the plurality of petals are configured to pivot radially outwards when the sealing element radially expands.

2. The packer of claim 1, wherein at least a portion of the axial force is transmitted from the gage ring to the sealing element via the plurality of petals.

3. The packer of claim 1, wherein the gage ring comprises a plurality of pockets formed in the axial face thereof, wherein the plurality of petals each comprise a hinge member at a root thereof, and wherein the hinge members of the plurality of petals being are pivotally received into the pockets of the gage ring.

4. The packer of claim 1, wherein the sealing element comprises a main portion and a recessed portion that extends from the axial end to the main portion, the main portion having a larger outer diameter than the recessed portion, and wherein the plurality of petals are positioned radially outwards of the recessed portion.

5. The packer of claim 4, further comprising a wedge ring positioned in the recessed portion, the wedge ring increasing in diameter as proceeding axially toward the main portion, wherein a tip of each of the plurality of petals is engagable with the wedge ring.

6. A packer, comprising:

a sealing element positioned at least partially around a tubular, the sealing element having an axial end;

a gage ring positioned at least partially around the tubular and adjacent to the axial end of the sealing element; and a plurality of petals pivotally coupled to the gage ring, extending at least partially axially therefrom toward the sealing element, and positioned radially outwards of the axial end of the sealing element, wherein the gage ring is movable axially along the tubular, towards the sealing element, such that the gage ring applies an axial force to the sealing element to expand the sealing element radially outwards, and wherein the plurality of petals are configured to pivot radially outwards when the sealing element radially expands, wherein the gage ring comprises a plurality of pockets formed in an axial face thereof, wherein the plurality of petals each comprise a hinge member at a root thereof, and wherein the hinge members of the plurality of petals being pivotally received into the pockets of the gage ring, and wherein each of the plurality of petals comprises a first section extending axially and in a first circumferential direction and a second section extending axially and in a second circumferential direction, the first section being radially outwards of the second section.

7. The packer of claim 6, wherein the first and second sections are integrally formed as a single piece.

8. The packer of claim 6, wherein each of the plurality of petals comprises a tip opposite to the root, and wherein each of the plurality of petals defines a circumferential width that increases as proceeding from the root to the tip.

9. The packer of claim 6, wherein the first section of each of the plurality of petals is configured to overlap the second section of an adjacent one of the plurality of petals.

10. A packer, comprising:

a sealing element positioned at least partially around a tubular, the sealing element having an axial end;

a gage ring positioned at least partially around the tubular and adjacent to the axial end of the sealing element;

a plurality of petals pivotally coupled to the gage ring, extending at least partially axially therefrom toward the sealing element, and positioned radially outwards of the axial end of the sealing element; and a retainer positioned at least partially around the plurality of petals, wherein the gage ring is movable axially along the tubular, towards the sealing element, such that the gage ring applies an axial force to the sealing element to expand the sealing element radially outwards, and wherein the plurality of petals are configured to pivot radially outwards when the sealing element radially expands, wherein the retainer is configured to break when the sealing element is expanded.

11. The packer of claim 10, wherein the retainer comprises one or more notches where the retainer is configured to break.

12. A method for packing a wellbore, comprising:

deploying a sealing element positioned around a tubular into the wellbore, the sealing element being in a run-in configuration; and causing a gage ring positioned axially adjacent to the sealing element to move toward the sealing element, wherein causing the gage ring to move causes the gage ring and a plurality of petals to apply an axial force to the sealing element, expanding the sealing element radially outward to a set configuration, and wherein as the sealing element expands radially outwards, the plurality of petals pivot radially outwards to prevent extrusion of the sealing element past the gage ring, wherein, when the sealing element is in the run-in configuration, the plurality of petals are positioned radially outward of an axial end of the sealing element, and wherein causing the gage ring to move causes a retainer positioned around the plurality of petals to rupture, allowing the plurality of petals to pivot outwards with respect to the gage ring.

13. The method of claim 12, wherein causing the gage ring to move comprises increasing a pressure within the tubular, the increased pressure being transmitted to the gage ring via a port in the tubular that communicates with a chamber in the gage ring.

14. The method of claim 12, wherein the plurality of petals are at least partially circumferentially overlapping when the sealing element is in the run-in configuration and when the sealing element is in the set configuration.

15. The method of claim 12, wherein causing the gage ring to move causes tips of the plurality of petals opposite to the gage ring to engage a wedge ring, the wedge ring being positioned around a recessed portion of the gage ring, and the wedge ring being harder than the sealing element.

16. An apparatus for packing a wellbore, comprising:

a sealing element positioned around a tubular and having a first axial end, a second axial end, and a main portion between the first and second axial ends, the sealing element being expandable to form a seal between the tubular and a surrounding wall;

a first gage ring positioned around the tubular, the first gage ring comprising an axial face that directly contacts the first axial end of the sealing element;

a second gage ring positioned around the tubular, the second gage ring comprising an axial face that directly contacts the second axial end of the sealing element;

a first plurality of petals pivotally coupled to the first gage ring and extending therefrom from the axial face towards the second gage ring, the first plurality of petals being positioned radially outward of at least a portion of the sealing element, wherein adjacent ones of the first plurality of petals are overlapping; and a second plurality of petals pivotally coupled to the second gage ring and extending from the axial face of the second gage ring towards the first gage ring, the second plurality of petals being positioned radially outward of at least a portion of the sealing element, wherein adjacent ones of the second plurality of petals are overlapping, wherein the first and second gage rings are movable axially along the tubular, towards the sealing element, such that the axial face of the first gage ring applies an axial force to the first axial end of the sealing element, and the axial face of the second gage ring applies an axial force to the second axial end of the sealing element, so as to compress the sealing element between the first and second gage rings, causing the sealing element radially outward, and wherein the first and second pluralities of petals are configured to pivot radially outward when the sealing element deforms radially outward.

17. The apparatus of claim 16, wherein the first gage ring defines a plurality of pockets therein, extending from the axial face thereof, the first plurality of petals each comprising a hinge member received into one of the pockets of the first gage ring, and wherein the second gage ring defines a plurality of pockets therein, extending from the axial face thereof, the second plurality of petals each comprising a hinge member received into one of the pockets of the second gage ring.

* * * * *